US008096435B2

(12) United States Patent
Auclair et al.

(10) Patent No.: US 8,096,435 B2
(45) Date of Patent: Jan. 17, 2012

(54) TRANSPORTING AND VENDING PACKAGE

(75) Inventors: Jean-Michel Auclair, Chateauroux (FR); Alain Saulas, Chateauroux (FR)

(73) Assignee: Meadwestvaco Packaging Systems, LLC, Richmond, VA (US)

( * ) Notice: Subject to any disclaimer, the term of this patent is extended or adjusted under 35 U.S.C. 154(b) by 620 days.

(21) Appl. No.: 12/297,605

(22) PCT Filed: Feb. 5, 2007

(86) PCT No.: PCT/US2007/061611

§ 371 (c)(1),
(2), (4) Date: Oct. 17, 2008

(87) PCT Pub. No.: WO2007/092812

PCT Pub. Date: Aug. 16, 2007

(65) Prior Publication Data

US 2009/0173661 A1 Jul. 9, 2009

(30) Foreign Application Priority Data

Feb. 3, 2006 (GB) ..... 0602204.0

(51) Int. Cl.

| | |
|---|---|
| ***B65D 6/28*** | (2006.01) |
| ***B65D 6/00*** | (2006.01) |
| ***B65D 21/00*** | (2006.01) |
| ***B65D 85/62*** | (2006.01) |
| ***B65D 1/22*** | (2006.01) |
| ***B65D 79/00*** | (2006.01) |

(52) U.S. Cl. ..... 220/4.33; 220/4.26; 220/4.27; 220/8; 206/512; 206/745; 229/102.5; 229/122.32; 229/125.19

(58) Field of Classification Search ..... 220/4.26, 220/4.27, 4.33, 8, 23.9, 23.91; 206/512, 206/745; 229/102.5, 122.32, 125.19
See application file for complete search history.

(56) References Cited

U.S. PATENT DOCUMENTS

| | | | | |
|---|---|---|---|---|
| 3,713,579 | A | 1/1973 | Chaffers | |
| 3,858,717 | A | 1/1975 | Peters | |
| 4,709,852 | A | 12/1987 | Stoll | |
| 5,348,147 | A | 9/1994 | Gottfreid | |
| 5,474,171 | A * | 12/1995 | Niesen et al. | 206/765 |
| 6,719,191 | B1 * | 4/2004 | Christensen et al. | 229/122.26 |
| 2004/0222127 | A1 * | 11/2004 | McLeod et al. | 206/736 |

FOREIGN PATENT DOCUMENTS

| | | | |
|---|---|---|---|
| EP | 0647565 | A1 | 4/1995 |
| EP | 1705125 | A | 9/2006 |

(Continued)

*Primary Examiner* — Anthony Stashick
*Assistant Examiner* — Madison L Wright
(74) *Attorney, Agent, or Firm* — MWV Intellectual Property Group

(57) ABSTRACT

A two-part (1, 2, 102, 118) transporting and vending package (52, 152) for containing and displaying articles (A). The articles are grouped and disposed upon the first part (1), which is augment by the second part (2) to give the package sufficient structural integrity to resist compressive forces being transmitted to the articles when the package is stacked with other such packages. The second part also restricts access to the articles. The package also comprises a releasable retaining means (24, 124) provided to maintain the first and second parts as a unit until access to the articles is required. The retaining means can be manipulated to deprive the package of its initial structural integrity and to provide improved access to the articles to facilitate vending.

15 Claims, 11 Drawing Sheets

FOREIGN PATENT DOCUMENTS

Figure 1B:
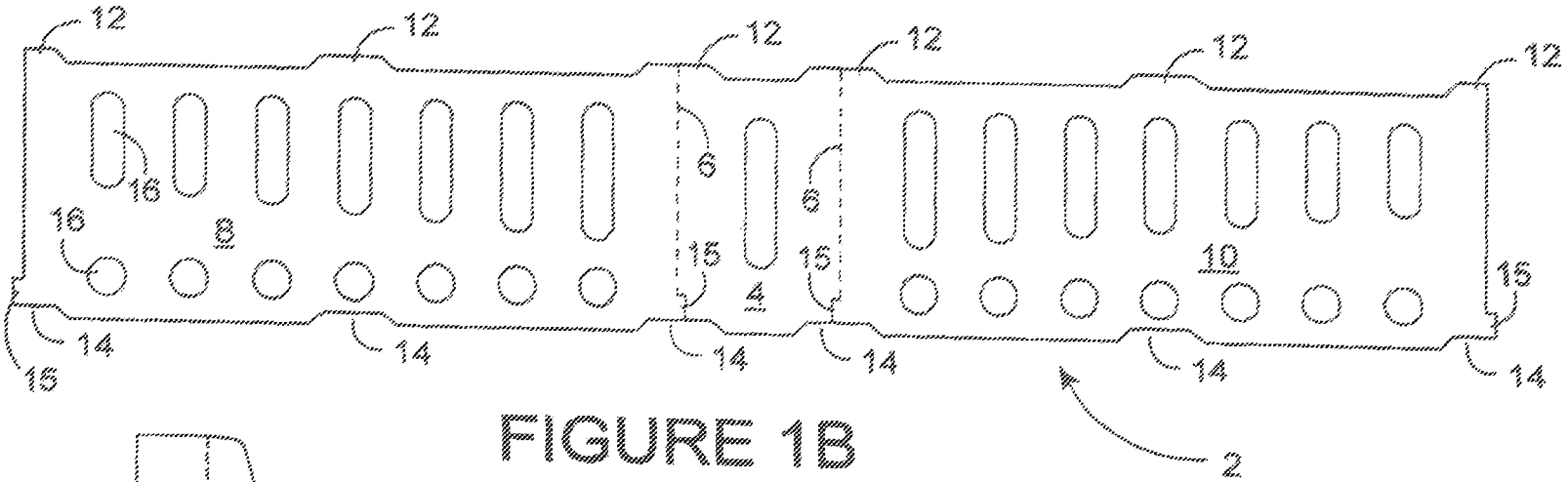

| | | | |
|---|---|---|---|
| FR | 2583020 | A | 12/1986 |
| FR | 2618412 | A1 | 1/1989 |
| FR | 2792287 | A1 | 10/2000 |
| FR | 2810300 | A1 | 12/2001 |
| GB | 2370034 | A | 6/2002 |
| GB | 2421020 | A | 6/2006 |
| JP | 07251870 | A | 9/2007 |
| WO | WO 03/082681 | A2 | 10/2003 |

* cited by examiner

TRANSPORTING AND VENDING PACKAGE

FIELD OF INVENTION

The present invention relates particularly though not exclusively to packages for packaging articles, and more particularly though not exclusively to packages that are suitable both for stacking and transporting as well as for use at a point of sale in a retail environment.

BACKGROUND OF INVENTION

Packages that are capable of transporting articles and of being stacked on top of one another are well known in the art, see U.S. Pat. No. 4,709,852. However, the material that provides sufficient strength in the package for stacking to take place also restricts access to the contents of that package, and therefore renders the package useless in a point-of-sale vending capacity.

Whilst designs of package are known wherein portions of the package may be torn or cut away from the remainder so as to increase access to the contents of the package, such as the package disclosed in WO 03082681, such solution are sub optimal in terms of the time and skill required to remove the relevant section, the potential hazard posed to the contents during the process of ripping or cutting, and the aesthetic quality of the remaining part.

The present invention therefore seeks to overcome or at least the problems of the prior art by providing a package which permits stacking in one configuration and which may then be reconfigured so as to facilitate the use of the package at a point-of-sale.

SUMMARY OF INVENTION

A first aspect of the present invention provides a package containing a group of articles comprising a carton comprising a two-part carton comprising a first part and a second part, said first part providing a base panel which receives a group of articles and a second part which provides a structural element sufficient to withstand a compressive force when the package is stacked with other such packages, and providing a retention structure for retaining the articles within the package, wherein the second part is in slidable contact with the first part, a structural element of the carton being removable by sliding the second part, with respect to the first part, whereby exposing the article group.

Preferably, wherein a portion of the first part provides a display panel for advertising purposes.

Preferably, wherein the package further comprises a locking mechanism for preventing the first part from being separated from the second part.

One advantage of the present invention over the prior art is that the package of the present invention may be placed between a pair of shelves prior to removal of a portion of the package whereby removal of said portion provides access to the articles contained therein.

A second aspect of the present invention a package for containing articles, which package comprises a first part and a second part, wherein the articles are grouped and disposed upon the first part, wherein the second part comprises spaced side walls that are maintained in a spaced relationship by at least one end wall, wherein the package may be stacked upon other like packages by virtue of the structural integrity provided by the second part, wherein the first pad and second part are in sliding contact with one another, wherein separation of the first part and second part is prevented by some retaining means, wherein the retaining means may be manipulated so as to allow the first part and second part to be separated from one another through a sliding motion along an axis in an plane of a lowermost surface of the package, wherein the articles remain disposed upon the first part and are readily accessible for removal.

Preferably, wherein said retaining means comprises one or more releasably engaging tab and aperture arrangements, wherein one or more tabs are provided by one part and corresponding one or more apertures are provided by another part.

Preferably, wherein the first part provides a display panel for the display of information or graphics.

Preferably, wherein the package further comprises apertures in one or more surfaces which apertures facilitate air flow around the articles.

Preferably, wherein the second part is disposed within the first part prior to the retaining being manipulated.

Preferably, wherein the first part is disposed within the second part prior to the retaining being manipulated.

Preferably, wherein the package comprises one or more external surfaces which define one or more detents along one edge, which detents defined in any given surface correspond with one or more indents defined within an opposing edge of the same surface.

Preferably, wherein at least one of said one or more detents is located astride a corner of the package such that the detent describes a right-angle.

A third aspect of the present invention provides a blank for forming a transporting and vending package which blank comprises of a first part and a second part, wherein articles are grouped and disposed upon the first part, and wherein the set-up second part augments the set-up first part to give the package sufficient structural integrity to resist compressive forces being transmitted to the articles when the package is stacked with other such packages whilst also restricting access to the articles, the second pad also comprising releasable retaining means provided to maintain the first, and second parts as a unit until access to the articles is required whereupon the retaining means can be manipulated to deprive the package of its initial structural integrity and thereby to provide improved access to the contents to facilitate vending.

A fourth aspect of the present invention provides a blank for forming a package for containing articles, which blank comprises a first part and a second part, wherein the articles are grouped and disposed upon the first part, wherein the second part comprises spaced side walls that are maintained in a spaced relationship by at least one end wall when set-up, wherein the package may be stacked upon other like packages by virtue of the structural integrity provided by the set-up second part, wherein the first part and second part are in sliding contact with one another, wherein separation of the set-up first part and set-up second part is prevented by some retaining means, wherein the retaining means may be manipulated so as to allow the set-up first part and set-up second part to be separated from one another through a sliding motion along an axis in an plane of a lowermost surface of the package, wherein the articles remain disposed upon the first part and are readily accessible for removal.

A fifth aspect of the present invention provides a transporting and vending package which package comprises a first part and a second part in which articles are grouped and disposed upon the first part, and wherein the second part augments the first part to give the package sufficient structural integrity to resist compressive forces being transmitted to the articles when the package is stacked with other such packages whilst also restricting access to the articles, the second part also comprising releasable retaining means provided to maintain the first and second parts as a unit until access to the articles is required whereupon the retaining means can be manipulated to deprive the package of its initial structural integrity and to provide improved access to the contents to facilitate vending.

Preferably, wherein the manipulation of the retaining means allows the first and second parts to be slid apart from one another.

Preferably, wherein the first and second parts are slid apart from one another along an axis in a plane of a lowermost surface of the package.

DETAILED DESCRIPTION OF THE FIGURES

Figure 1A:
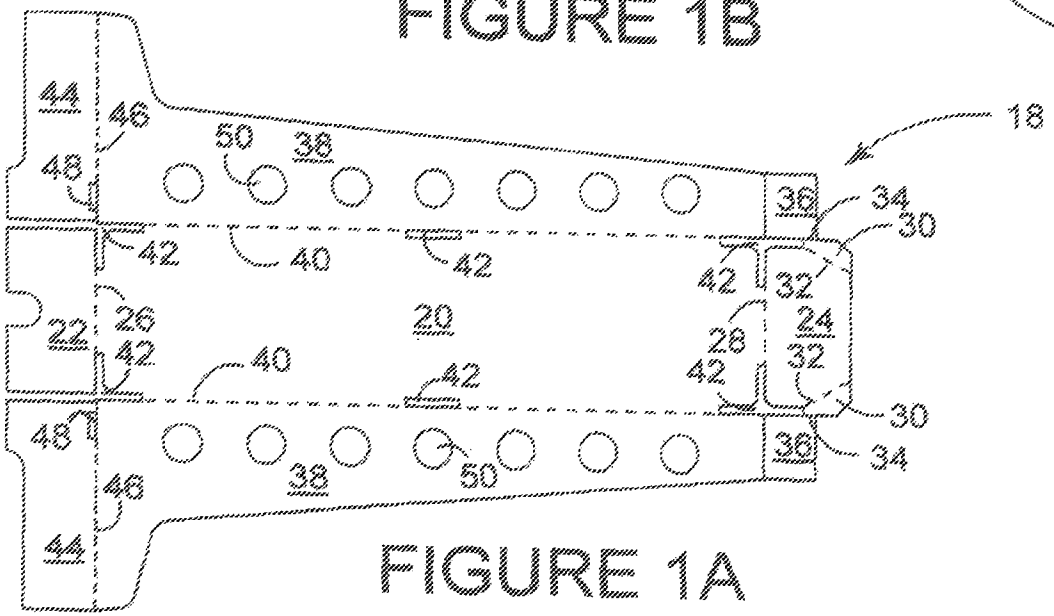
Figure 2A:
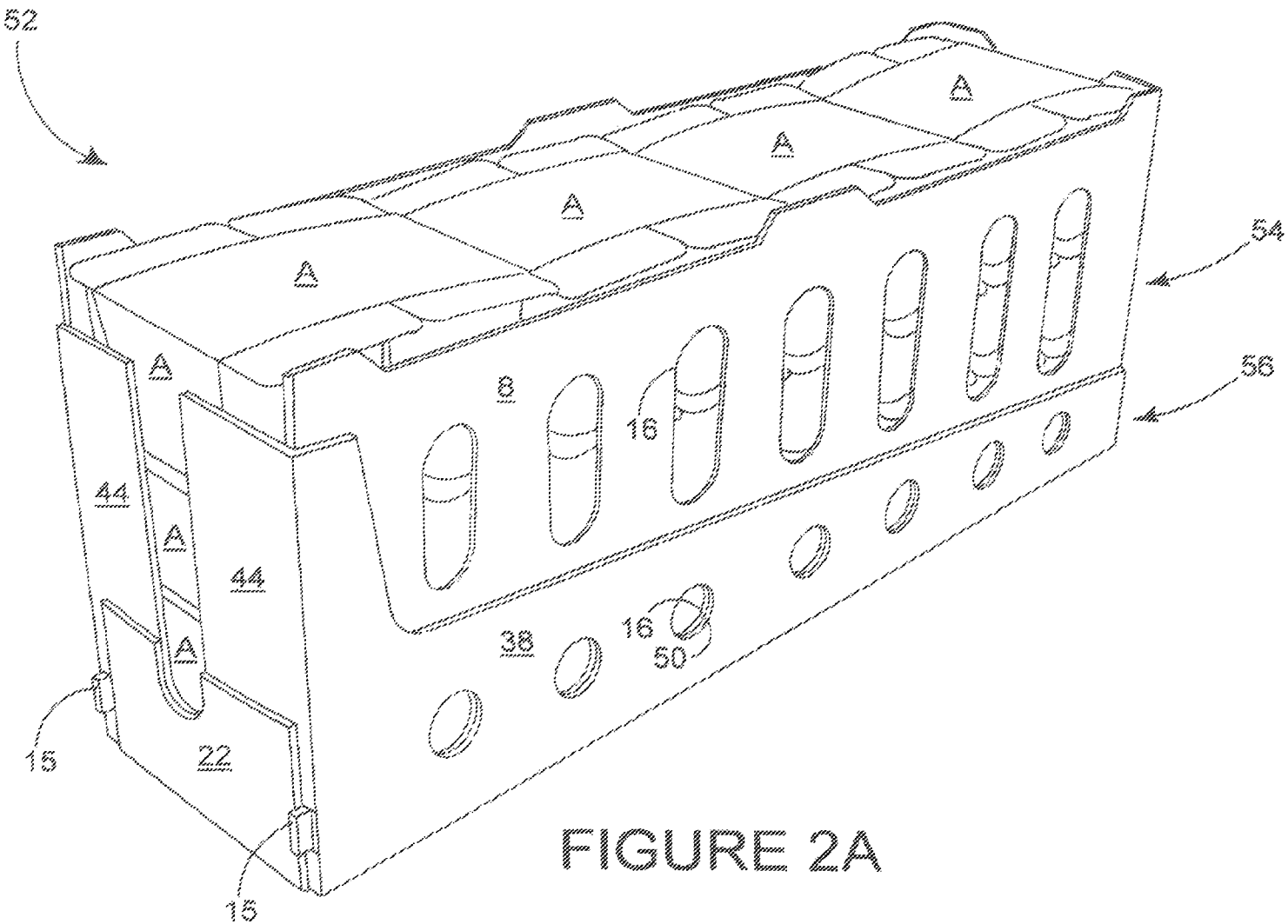
Figure 2B:
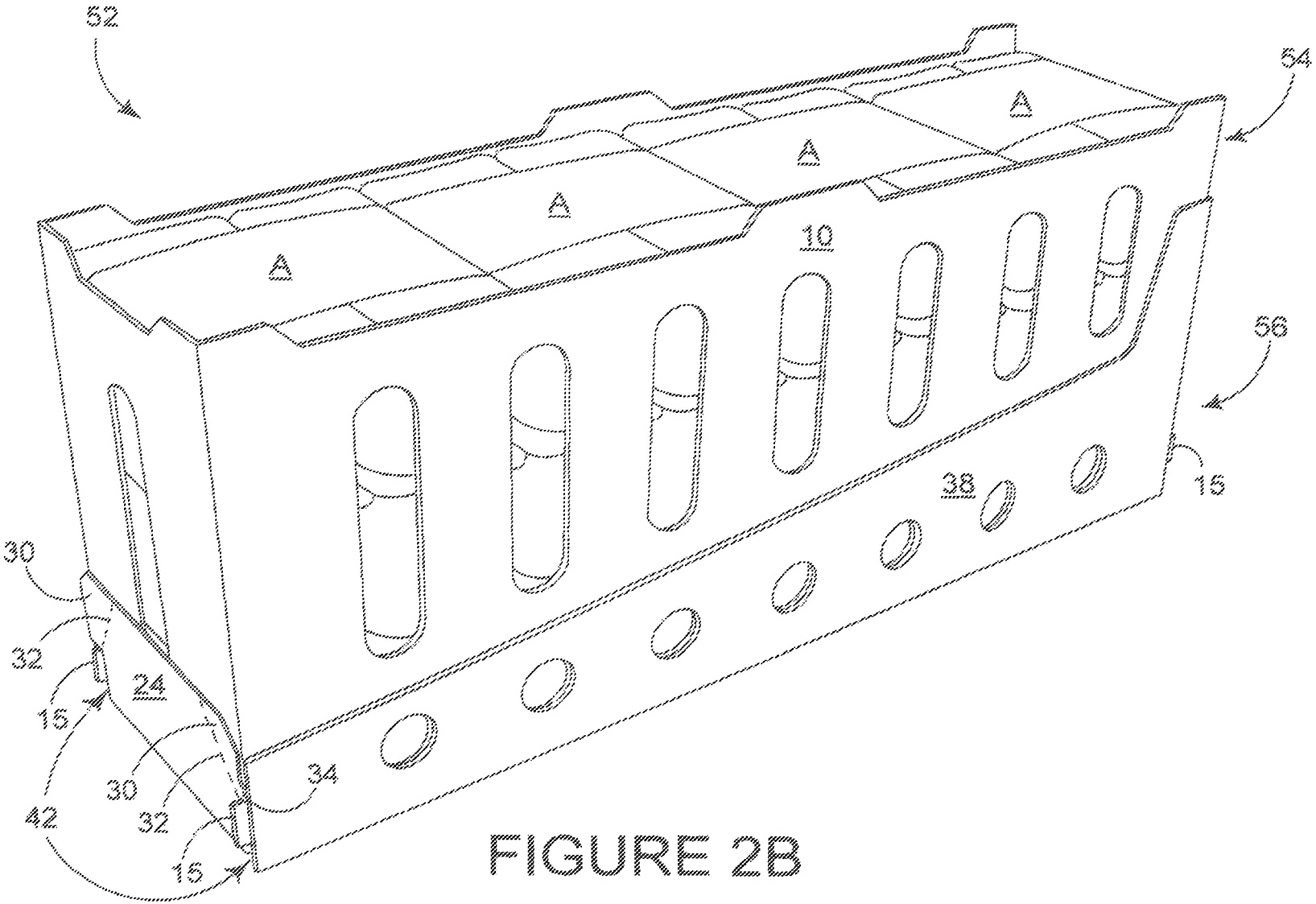
Figure 3:
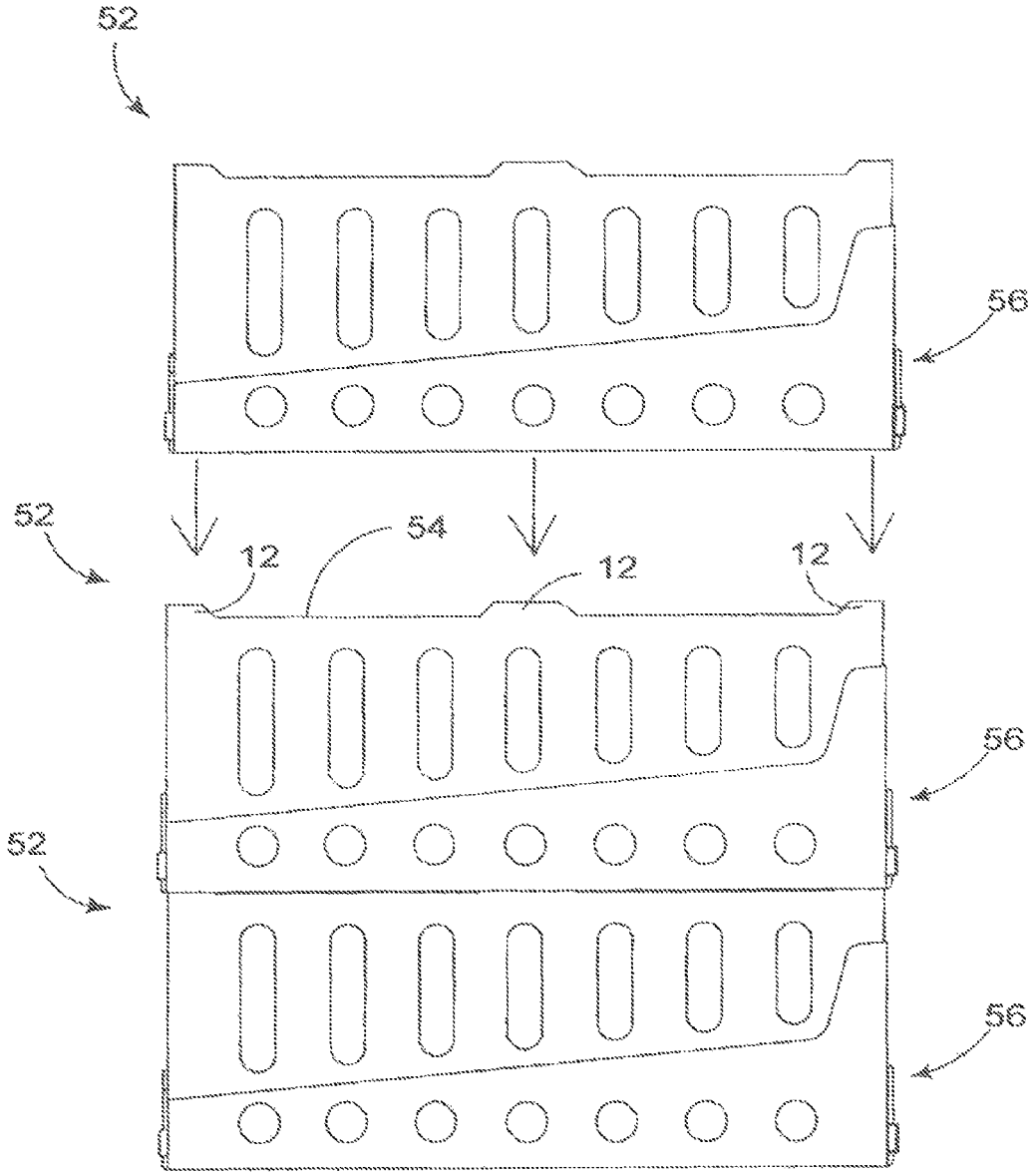
Figure 4:
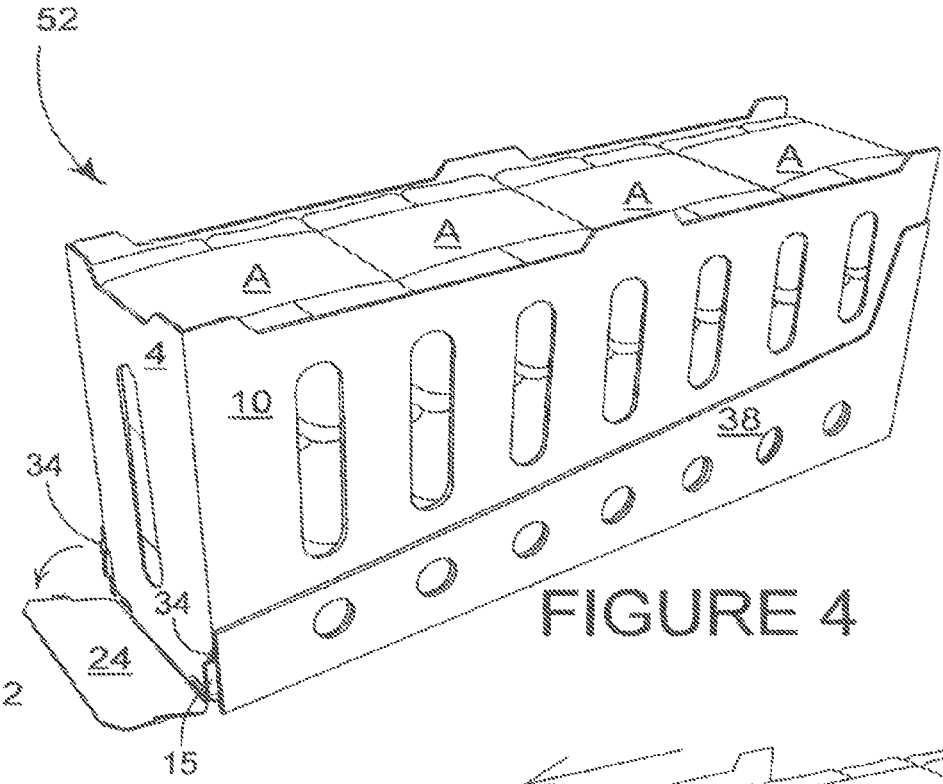
Figure 5:
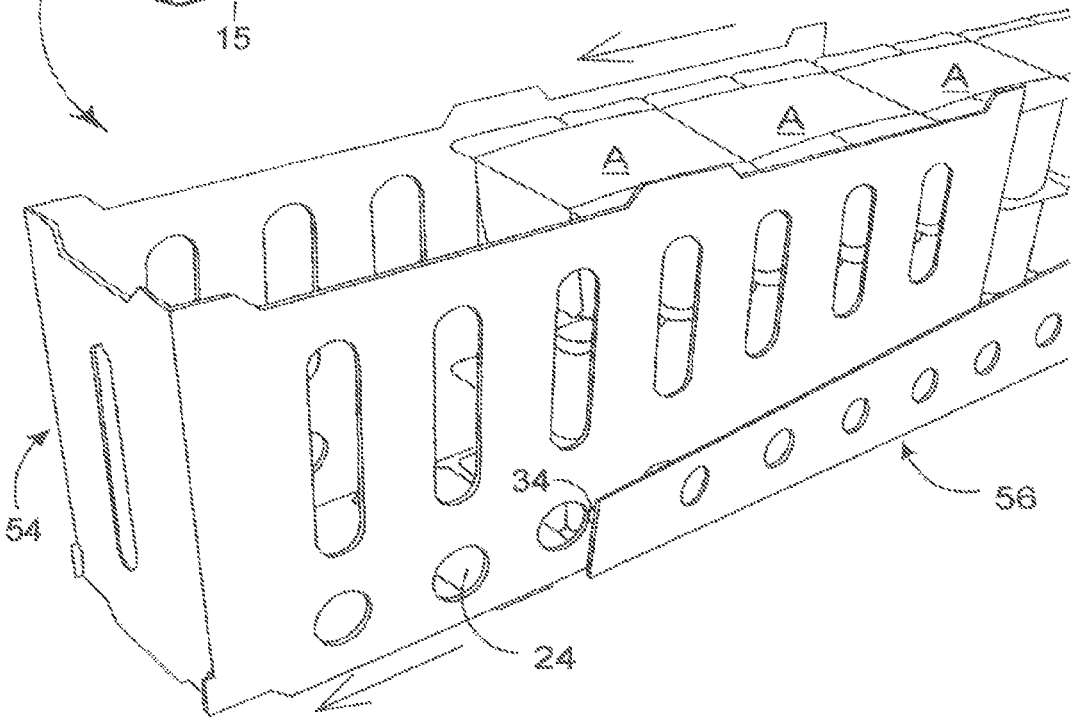
Figure 6:
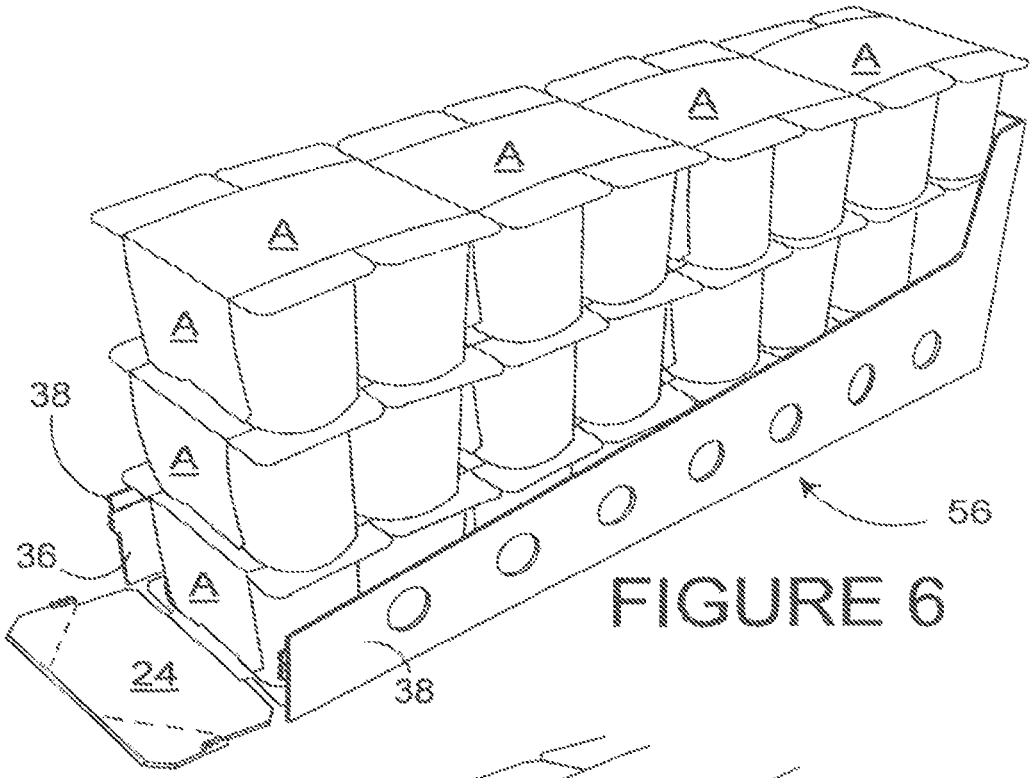
Figure 7:
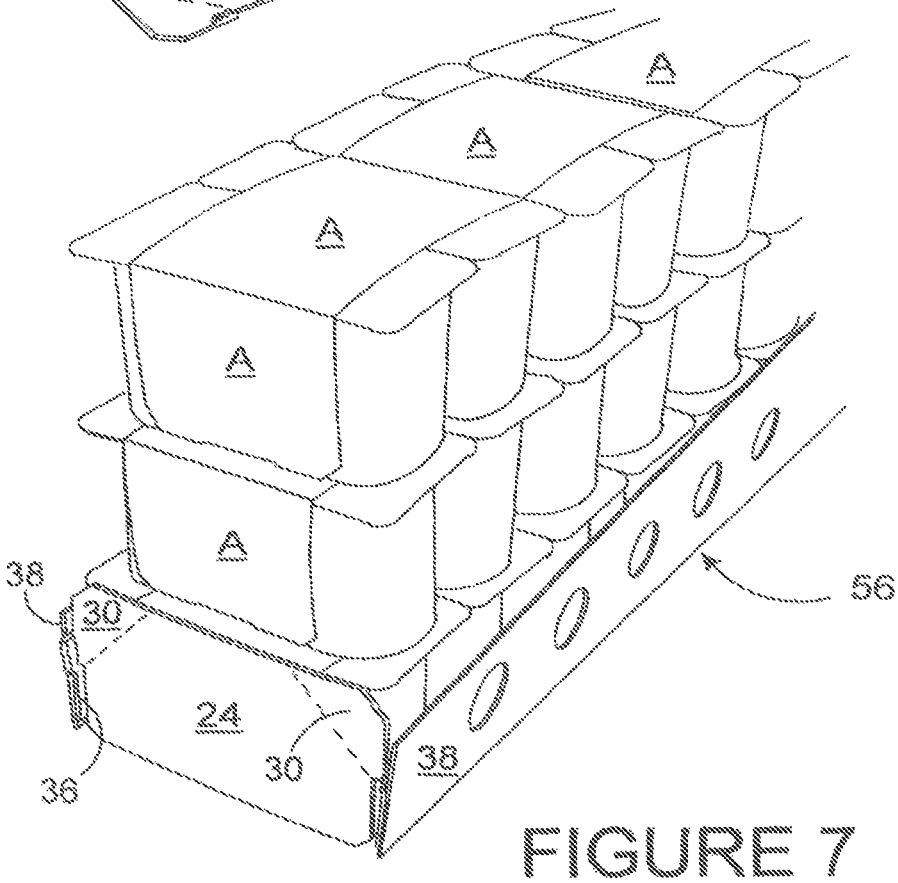
Figures 8A, 8B:
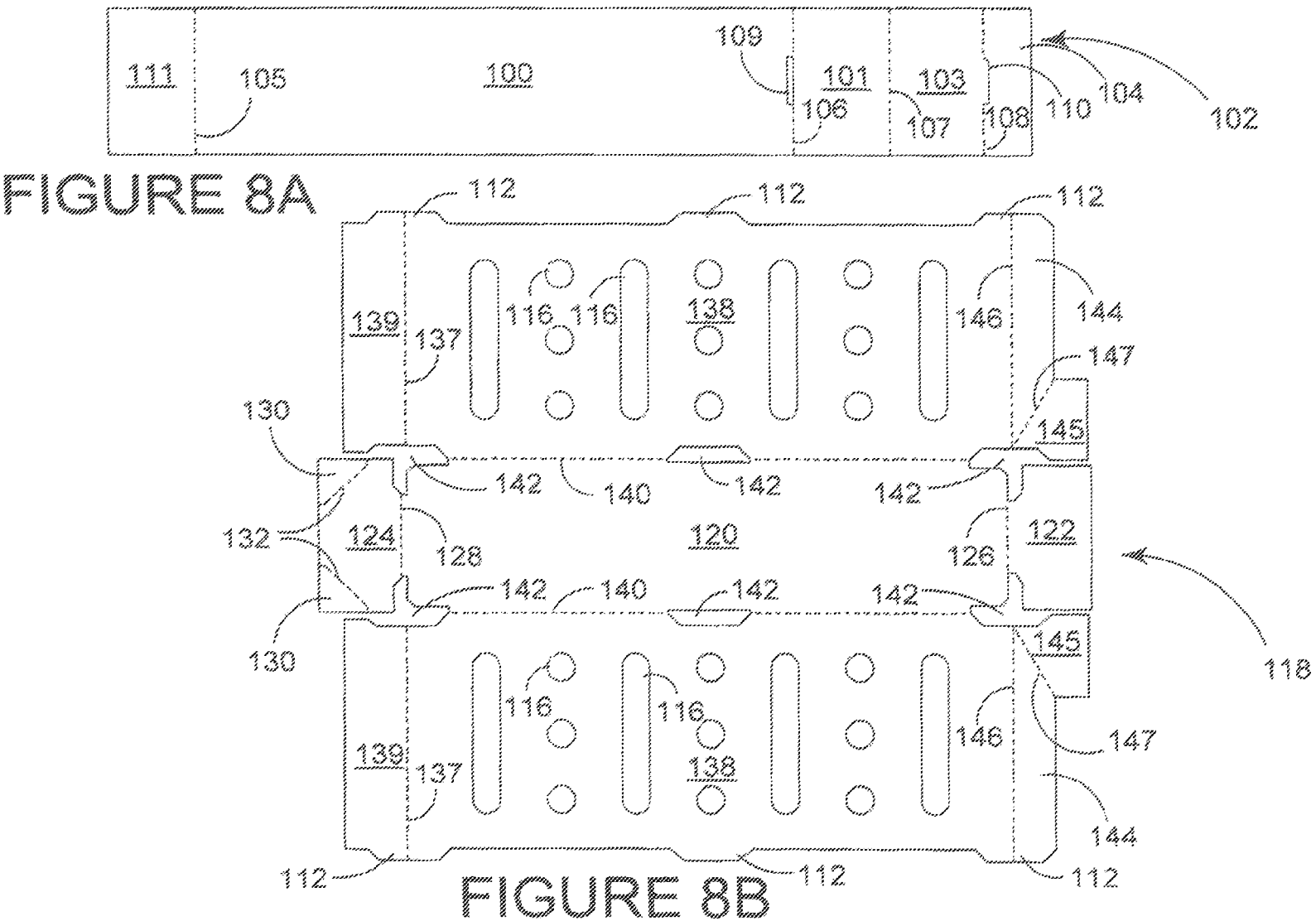
Figure 9:
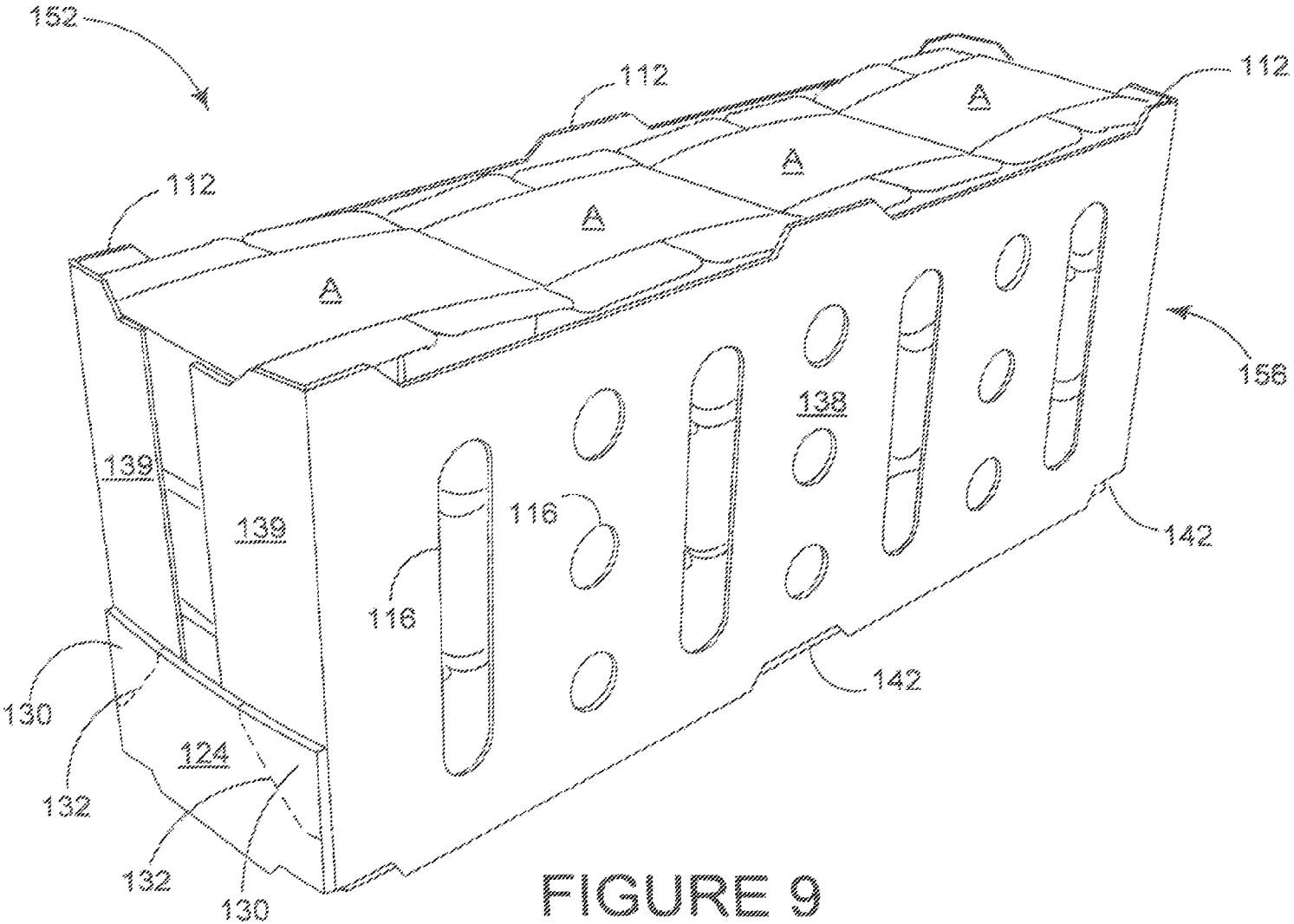
Figure 10:
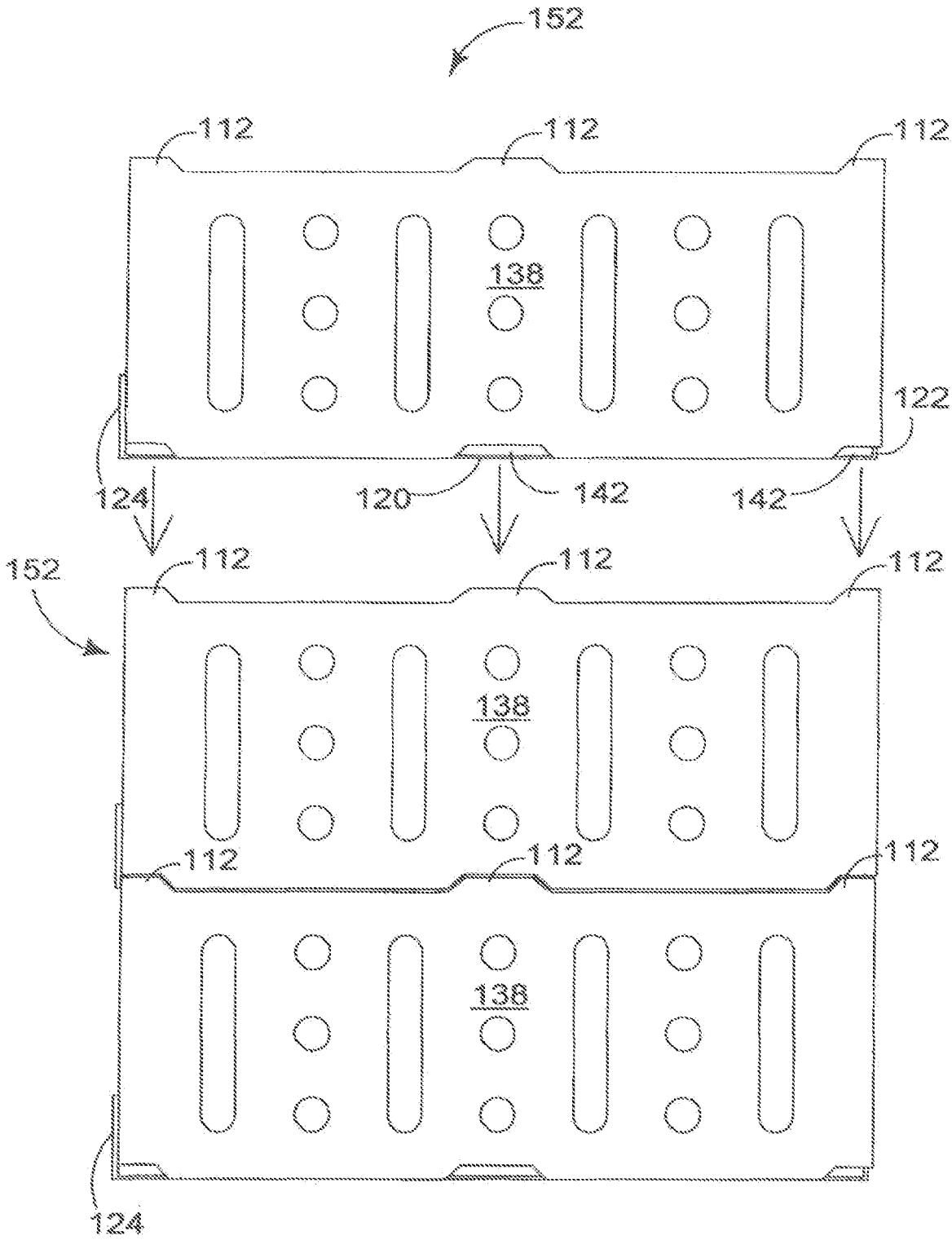
Figure 11:
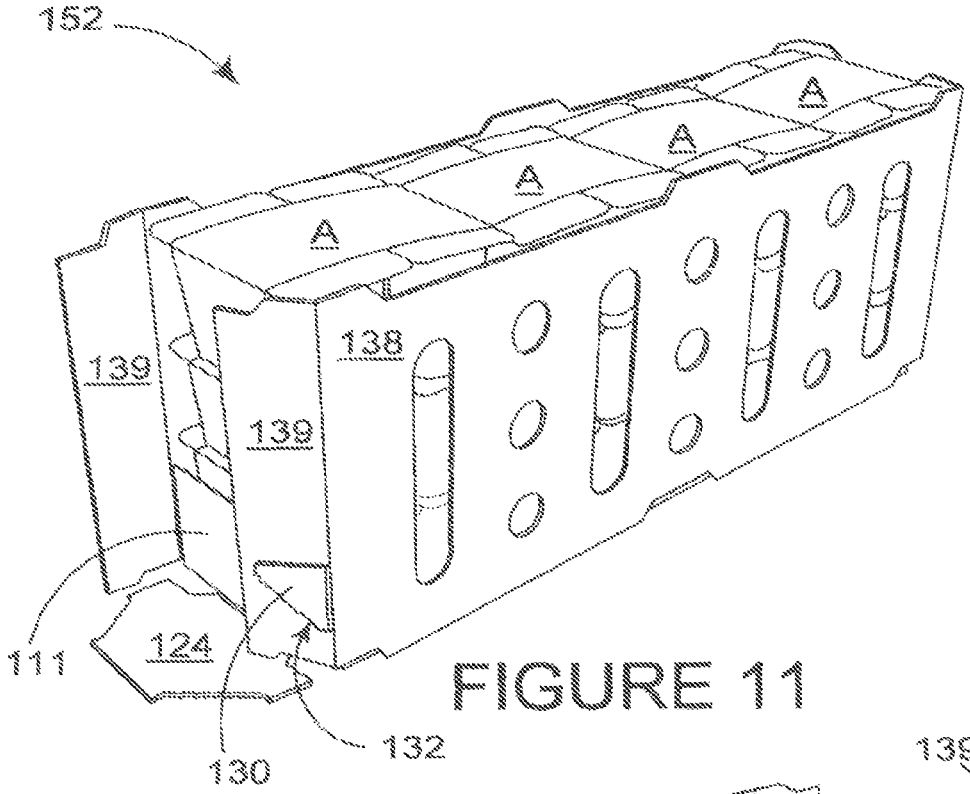
Figure 12:
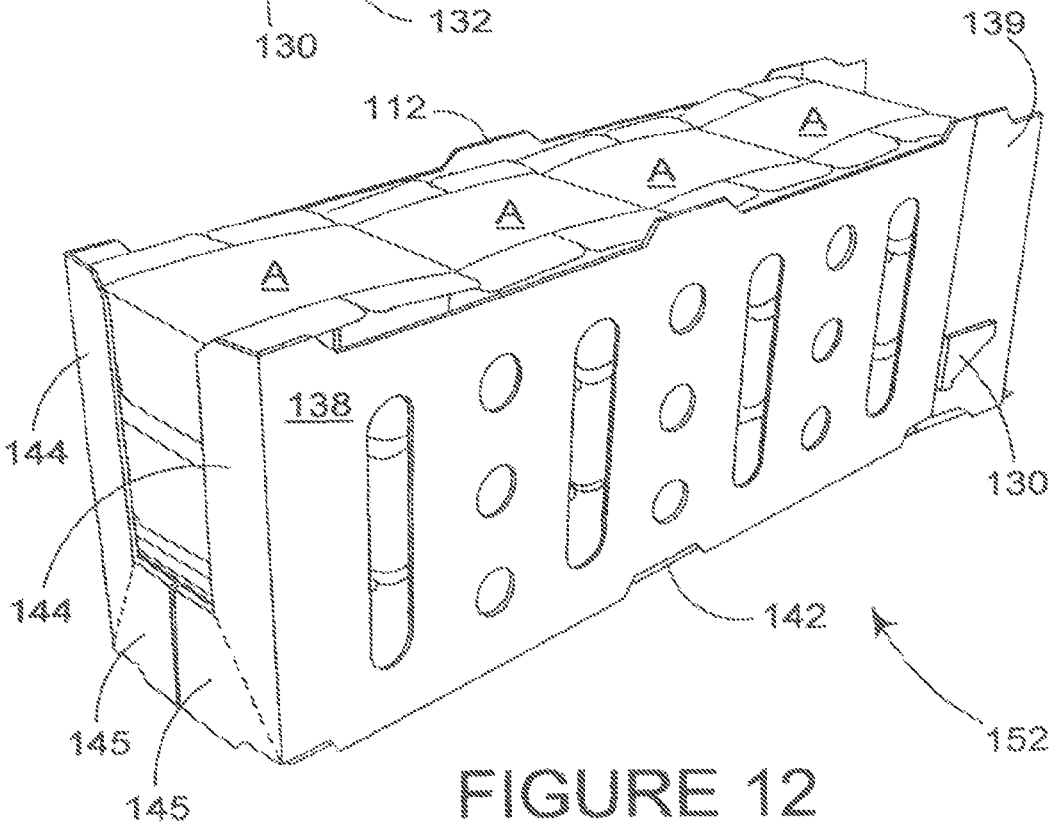
Figure 13:
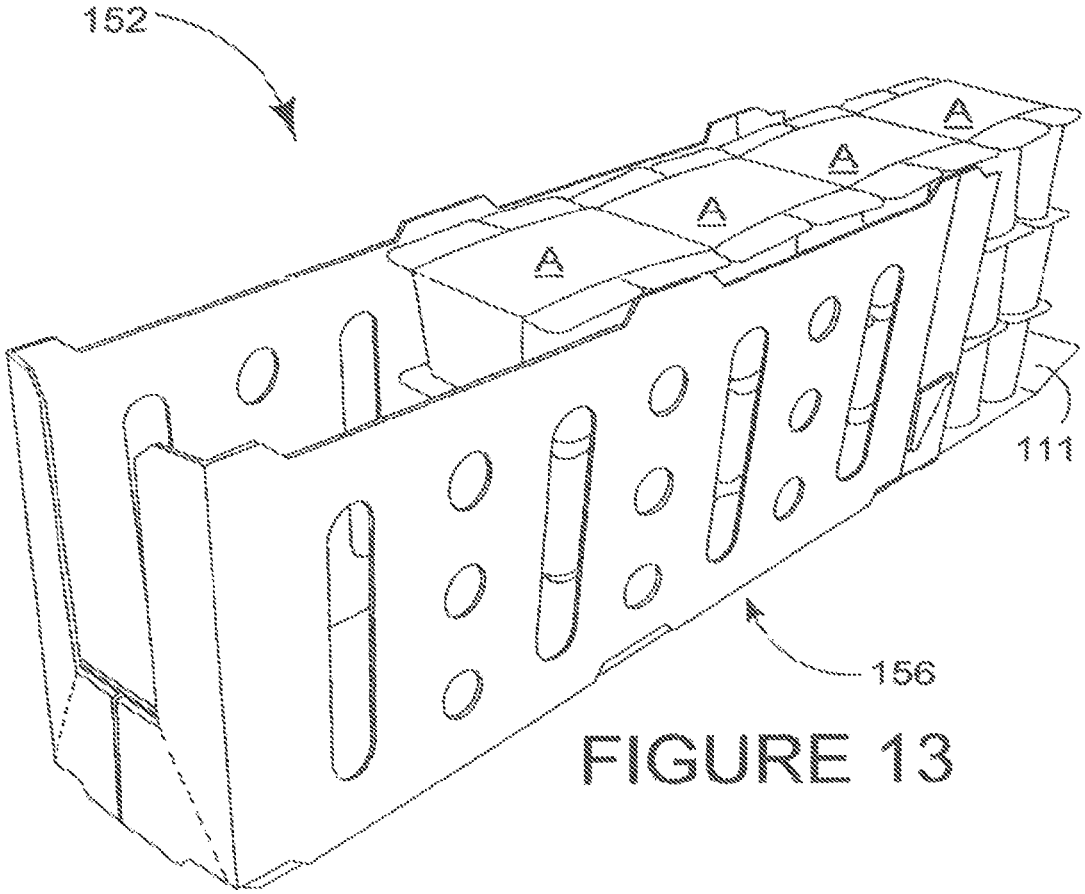
Figure 14:
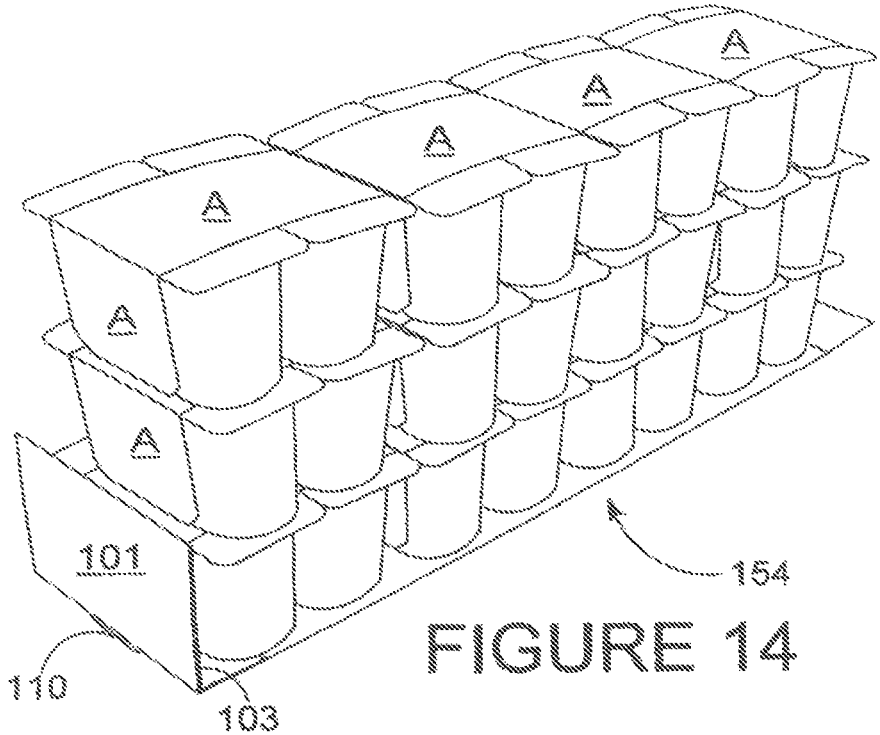

Exemplary embodiments of the present invention will now be described with reference to the accompanying drawings in which;

FIG. 1A illustrates a plan view of a first blank for forming a first part of a package, according to a first exemplary embodiment of the present invention, FIG. 1B illustrates a plan view of a second blank for forming a second part of a package, according to a first exemplary embodiment of the present invention, FIG. 2A illustrates the top-rear perspective view of a set up package, according to a first exemplary embodiment of the present invention, loaded with articles, FIG. 2B illustrates a top-front perspective view of a set up package, according to a first exemplary embodiment of the present invention, loaded with articles, FIG. 3 illustrates a side elevation of multiple packages, according to a first exemplary embodiment of the present invention, being stacked vertically upon one another, FIG. 4 illustrates a top-front perspective view of the package of FIG. 2B, part way through the process of separating the two parts of the package, FIG. 5 illustrates a top-front perspective view of the package of FIG. 4, further through the process of separating the two parts of the package, FIG. 6 illustrates a top-front perspective view of the package of FIG. 5, wherein the second part has been removed, showing the articles disposed upon a remaining part of the package, FIG. 7 illustrates a fragmentary top-front perspective view of the package of FIG. 8, that is ready for use as a point-of-sale, FIG. 8A illustrates a plan view of a first blank for forming a first part of a package, according to a second exemplary embodiment of the present invention, FIG. 8B illustrates a plan view of a second blank for forming a second part of a package, according to a second exemplary embodiment of the present invention, FIG. 9 illustrates a top-rear perspective view of a set up package, according to a second exemplary embodiment of the present invention, loaded with articles, FIG. 10 illustrates a side elevation of multiple packages, according to a second exemplary embodiment of the present invention, being stacked vertically upon one another, FIG. 11 illustrates a top-rear perspective view of the package of FIG. 9, part way through the process of separating the two parts of the package, FIG. 12 illustrates a top-front perspective view of the package of FIG. 9, further through the process of separating the two parts of the package, FIG. 13 illustrates a top-front perspective view of the package of FIG. 9, still further through the process of separating the two parts of the package, and FIG. 14 illustrates a top-front perspective view of the package of FIG. 13, wherein the second part has been removed, showing the articles disposed on the first part of the package and ready to be used as a point-of-sale.

DETAILED DESCRIPTION OF THE EXEMPLARY EMBODIMENTS OF THE PRESENT INVENTION

FIG. 2A illustrates a package 52 formed of foldable sheet material such as paperboard, according to a first embodiment of the present invention. The package 52 comprises a first part 56 formed from a first blank 18, as shown in FIG. 1A, and a second part 54 formed from a second blank 2, as shown in FIG. 1B.

FIG. 1A illustrates the first blank 18 which forms the first part of the package 52. The first blank 18 comprises a base panel 20, hinged at one end, along fold line 26, to a rear end panel 22. Further, the base panel 20 is hinged at an opposing end, to front end panel or retaining means 24, along fold line 28.

Front end panel 24 comprises two fold lines 32, defining two corner regions 30 which may be folded out of the plane of the front end panel 24 as described below. Each corner region 30 is hinged, along frangible lines 34 located along opposing side edges of the front end panel 24, to front end flaps 36 disposed either side of end panel 24.

First blank 18 further comprises side panels 38 hinged along opposed fold lines 40 to the base panel 20. A series of apertures 42 are formed in the base panel 20, along fold line 40. The apertures 42 are spaced similarly to the detents 12 of the upper longitudinal edge of second blank 2, so that upon forming both the first and second blanks 18, 2 into a package 52, the detents 12 are receivable in the apertures 42. In the preferred embodiment shown, the apertures 42 are open, due to the separation of rear end panel 22 from side panels 38 and rear end flaps 44, at the corners of base panel 20 adjacent rear end panel 22. Although it is envisaged that in alternative embodiments, the form of apertures 42 adjacent rear end panel 22 may be substantially similar to those adjacent front end panel 24.

Each side panel 38 is hinged to a rear end flap 44, along fold lines 46 at corresponding ends closest to rear end panel 22. Defined within each rear end flap 44, is an engaging aperture 48 disposed proximate fold lines 46 and offset from an edge of each rear end flap 44, closest to rear end panel 22, by a distance equal to the height of indents 14 of FIG. 1A.

Defined within each side panel 38 may optionally be a series of apertures 50, corresponding in number and arrangement to apertures 16 formed in the side support panels of FIG. 1B, further details of which are given below in relation to the set up package 52.

FIG. 1B illustrates the second blank 2 comprising three panels 4, 8 and 10, hinged one to the next in a linear series. More specifically, the second blank 2 comprises an end support panel 4, hinged about fold lines 6, on either side, to respective first and second side support panels 8, 10.

Each side support panel 8, 10 is provided with a pair of tabs 15. Each tab 15 protrudes from an end edge of a side support panel 8, 10 adjacent a lower edge thereof. Tabs 15, protruding from hinged edges 6, extend into end support panel 4 when the second blank 2 is in flat form.

Second blank 2 comprises a series of detents 12 along a longitudinal edge corresponding to an upper longitudinal edge of the second part 54, as shown in FIG. 2A. The series of detents 12 comprise at least one detent 12 disposed astride each of fold lines 6. Furthermore, the series of detents 12 comprises a detent 12 located at each end of the upper longitudinal edge. Still further, the series of detents 12 includes a detent 12 disposed substantially midway along those portions of the upper longitudinal edge that correspond to an edge of each of the two side support panels 8, 10. It is contemplated that the number and arrangement of the detents 12 may be altered, from that described above, as required.

Second blank 2 also comprises a series of indents 14 formed along a lower longitudinal edge opposing said upper longitudinal edge of the second pad 54. The number and arrangement of the series of indents 14 is complementary to and corresponds with that of the series of detents 12 formed on the upper longitudinal edge. Each indent 14 is vertically aligned with a corresponding detent 12 and substantially is identical in size and shape.

Defined within the end and support panels 4, 8/10 of the blank 2, are a multiplicity of apertures 16 to facilitate the cycle of cold air through the package 52 when the package 52 is used to contain refrigerated goods. However these apertures 16 are entirely optional and it is contemplated that such apertures 16 may be omitted or distributed in any arrangement as required.

FIG. 2A illustrates the set up package 52, comprising a first part 56, formed from first blank 18 of FIG. 1A, and a second part 54, formed from second blank 2 of FIG. 1B. The package 52 has been loaded with articles (A) and the first part 56 has been formed around the second part 54. FIG. 2B illustrates the way in which the second part 54 is orientated such that the edge along which the indents 14 are disposed is lowermost and in abutment with an upper surface of the base panel 20. The first part 54 is further orientated such that a portion of the end panel 4 is in coplanar contact with front end panel 24.

The process of forming the package 52 from the first and second blanks 18, 2 of FIGS. 1A and 1B begins with second blank 2 being folded around the previously grouped articles (A). This is accomplished by folding the side support panels 8, 10 out of the plane of the end panel 4, along fold lines 6, such that the support panels 8, 10 come into contact with opposed sides of the grouped articles (A).

The grouped articles (A) and the second part 54 are arranged over the base panel 20, of FIG. 1A, and the first pad 56, illustrated in FIG. 2A, is formed around them. The process of forming the first part 56 of FIGS. 2A/2B, from the blank 18 of FIG. 1A, involves the folding of side panels 38 out of the plane of, and substantially perpendicular to, the base panel 20.

FIG. 2A illustrates how the rear end flaps 44, connected to each side panel 38, are then folded toward one another so as to become orientated substantially perpendicular to the side panels 38. In doing so, the tabs 15, protruding from the side support panels 8, 10 illustrated in FIG. 1B, protrude through the engaging apertures 48 defined within the rear end flaps 44. Rear end panel 22 is then folded up into an orientation of coplanar contact with portions of rear end flaps 44 and secured in that orientation by the application of a fastening means known in the art such as adhesive or a mechanical fastener. FIG. 2A also illustrates the way in which rear end panels 22 are sized so as not to interfere with the protrusion of the tabs 15 through the engaging apertures 48. Further illustrated in FIG. 2A is the way in which the rear end flaps 44 and the rear end wall 22 may optionally be cooperatively shaped so as to define, when formed and secured in the manner herein described, an aperture or recess in the end of the package 52, for facilitating air flow around the articles (A) contained in the package 52.

FIG. 2B goes on to illustrate the way in which the front of the package 52 is set up. Front end flaps 36, of FIG. 1A, are each folded out of the plane of front end panel 24 info the corresponding planes of side walls 38. Front end panel 24 is then folded toward the articles (A), in so doing bringing front end flaps 36 into coplanar contact with portions of corresponding side panels 38, which contact is maintained by some form of fastening known in the art, such as adhesive or mechanical fastener. The continuation of apertures 42 into portions of the front end panel 24, allows the tabs 15, protruding from the edges of the support panels 8, 10 to pass between the front end panel 24 and the front end flaps 36.

Once fully loaded and set up, the packages 52 are ready to be transported and stored. Considering FIGS. 1A, 1B and 3 together illustrates the way in which the detents 12, disposed along the uppermost edge of each package 52, are aligned with the apertures 42 disposed in the base panel 20 of a package 52 stacked above. Thus the detents 12 are able to protrude though said apertures 42 substantially to locate with the indents 14, located in the lower longitudinal edge of the second part 54, of said package 52 stacked above. Thus the stacked packages 52 are engaged in such a way as to resist any relative lateral movement between the packages 52. The packages 52 may only be removed from the stack after being lifted sufficiently for detents 12 of the package 52 below, to become fully withdrawn from the apertures 42 disposed beneath. The detent 12 disposed astride the fold line 6 enables the detent 12 to fit info the corner aperture 42 (adjacent end panel 24) of a to package 52 stacked above thereby to further resist dislodgement of any stacked packages 52 through displacement in the longitudinal axis of the packages 52 as well.

The package 52, once removed from the stack, may be deployed so as to allow its use at a point of sale. FIGS. 4, 5, 6 and 7 show the sequence of the deployment process taking place.

Firstly, front end panel 24 is pulled, so as to break the frangible lines 34 and allow the front panel 24 to be orientated substantially in the plane of a lowermost surface of the package 52.

The first part 56 is thus opened at one end, and the user may pull the second pad 54 laterally away from the first part 56, along its longitudinal axis, as shown in FIG. 5.

FIG. 6 illustrates how the grouped articles (A) are left in place, on the first part 56, with the front end panel 24 free to hinge about fold line 28. FIG. 6 also illustrates, more clearly, the remaining front end flaps 36, fastened to the inner surfaces of side panels 38.

FIG. 7 illustrates the front end panel 24 being hinged upwards and engaging with the front end flaps 36 secured to the side panels 38. Folding corner regions 30 of front end wall panel 24, allows the effective width of the widest portion of front end panel 24 to be reduced so as to allow it to fit between the side panels 38. A further option is that of using the corner regions 30 of the front end panel 24 to engage under flanged portions of the foremost articles (A). The fact that the front end panel 24 is not removed, offers the opportunity for billboard information or advertising material to be displayed, such as promotional information relating to the product, on the front end panel 24.

A second embodiment of the present invention will now be described with reference to FIGS. 8A through to 14 in which like reference numerals have been used to denote like features, albeit the numerate have been raised by a factor of '100.'

FIG. 8A illustrates the first blank 102, which comprises a base insert 100, hinged at one end to a pull tab 111, about fold line 105, and at the other end to a display panel 101, about a fold line 106. The base insert 100 also comprises a retaining aperture 109 proximate fold line 106.

Display panel 101 is then hinged to support panel 103, about fold line 107, which support panel 103 is then hinged, in turn, to a support flap 104, about fold line 108.

Engagement tab 110 extends from support panel 103, into a portion of support flap 104.

FIG. 8B illustrates the second blank 118 comprising a base panel 120 hinged at opposing sides to side panels 138, along fold lines 140. The base panel 120 is further hinged at one end to a front end panel 122, along fold line 126, and at an opposing end to a rear end panel or retaining means 124, along fold line 128. Defined astride fold lines 140 and 128 are apertures 142 that extend from the base panel 120 into the side panels 138 and from the base panel 120 into the rear/front end panels 124/122 respectively.

The second blank 118 comprises a series of detents 112 along a longitudinal edge corresponding to an upper longitudinal edge of the set up second part 156, as shown in FIG. 9. The series of detents 112 includes detents 112 which are disposed astride each of fold lines 137 and 146. The series of detents 112 further includes detents 112 located substantially at the midpoint of the longitudinal edges.

Second blank 118 also comprises a series of indents or apertures 142 formed along a longitudinal edge corresponding to a lower longitudinal edge of the second part 156. The number and arrangement of the series of indents or apertures 142 is complementary to and corresponds with that of the series of detents 112 formed along the upper longitudinal edge. Each indent or aperture 142 is vertically aligned with a corresponding detent 112 and substantially is identical in size and shape.

Each side panel 138 is hinged at one end, to a front end flap 144, along fold lines 146, and at an opposing end to a rear end flap 139, along fold lines 137. Defined within each side panel 138 is an optional series of apertures 116 which allow air flow is around any article (A) contained within the package 152 to facilitate refrigeration of articles (A).

Each front end flap 144 is hinged, along an angled fold line 147, to a bottom end flap 145.

Rear end panel 124 comprises two detachable corner regions 130, defined by frangible lines 132.

FIG. 9 illustrates the fully set up and loaded package 152 wherein the articles (A) are grouped together and disposed upon the first part 154, illustrated in FIG. 14, around which the second part 158 is formed. Alternatively, the second part 156 may be partially set up, as described below, before the first part 154 and the articles (A) are deposited within it.

The set up process that forms the package 152, of FIG. 9, from first and second blanks 102, 118, of FIGS. 8A and 8B, comprises the steps described below.

Considering FIG. 8A and 9 in combination; support panel 103 is folded into coplanar contact with display panel 101, about fold line 107. Thus support tab 104 is also brought into coplanar contact with a portion of base insert 100 and engagement tab 110 is substantially aligned above retaining aperture 109.

Articles (A) are grouped and disposed upon base insert 100 and support flap 104. Support panel 104 and display panel 103, are then folded towards the articles (A) so as to be substantially perpendicular to base insert 100. Engagement tab 110 is thus rotated about the axis of fold line 106 so as to pass through retaining aperture 109, with which it engages. Pull tab 111 is then folded up into contact with the articles (A), about fold line 105.

Considering FIG. 8B and 9 in combination, side panels 138 are folded perpendicular to the base panel 120 about fold lines 140. Front end panel 122 is folded towards the rear end flaps 144 so as to become orientated perpendicular to the base panel 120. Front end flaps 144 are then folded toward one another about fold lines 146 until bottom flaps 145 and portions of front end flaps 144 are brought info an orientation of coplanar contact with front end panel 122, in which orientation the bottom/end flags 144/145 are secured by some fastening means known in the art such as adhesive or mechanical fastener.

The second part 156 is in a partially set up condition at this point in the process and the first part 154, loaded with articles (A), may be located within the second part 156, if it has not already been so located. The first part 154 and grouped articles (A) are orientated such that the display panel 101 is in substantially coplanar contact with the front end flap 122.

Front end flaps 139 are then folded, about fold lines 137, internally of the package 152 so that they are perpendicular to side panels 138. Front end flap 124 is then folded, about fold line 128, into coplanar contact with the front end flaps 139. Some fastening means known in the art such as adhesive or mechanical fastener is then used to secure each corner region 130 of front end panel 124, to a portion of each of the respective front end flaps 139 thus completing the sat up process of the package 152.

FIG. 10 thus illustrates the stacking of fully set up packages 152 according to this second embodiment of the present invention.

FIG. 10 also illustrates the way in which apertures 142, extending from the base panel 120 into the side panels 138, and from the base panel 120 into the rear/front end panels 122/124, complement the detents 112 protruding from the uppermost edge of the package 152 below, such that a releasable engagement occurs between each package 152 when stacked upon one another. Detents 112 protruding from the second part side wails 138 of the package 152 below prevent horizontal transverse displacement of the package 152 above, whilst detents 112 protruding from portions of the rear/front end flaps 139/144, illustrated in FIG. 8B, prevent horizontal longitudinal displacement of the package 152 above.

Once the package 152 is ready to be used, it may be reconfigured for use as a point-of-sale, as illustrated in FIGS. 11 to 14.

FIG. 11 illustrates the way in which the rear end panel 124 is pulled away from rear end flaps 139, thus breaking frangible lines 132 connecting the corner regions 130 to the remainder of the rear end panel 124. The corner regions 130 remain fastened to portions of rear end flaps 139, whilst the rear end panel 124 is freed to hinge downwards.

FIG. 11 also illustrates the rear end panel 124 hinged downward so as to allow rear end flaps 139 to hinge open to reveal the articles (A) contained inside the package 152. Pull tab 111 is also revealed once the rear end flaps 139 are opened.

FIGS. 12 and 13 illustrates how, at this point, the package 152 is located, with the front flaps 144 facing the eventually user of the point of sale. The pull tab 111 is then used to retain the first pad 154, as a force is applied to the second part 156 along an axis parallel to the base panel 120 such that the second part is removed.

FIG. 14 illustrates the remaining first part 154, upon which the grouped articles (A) are disposed ready for removal. Display panel 101 is foremost and may display promotional information regarding the product. The display panel 101 is retained in position by the engagement of engaging tab 110 with retaining aperture 109.

The above description refers to two exemplary embodiment of the present invention; it is conceivable that the inventive concept may be applied to other packaging designs wherein it is necessary to provide sufficient structural integrity so as to allow stacking of such packages upon one another whilst further allowing the same packaging to be used as a point-of-sale.

The exact geometry of the packages of either embodiment described above is exemplary and does not limit the scope of the invention herein described. The number or shapes of the panels of either blank may well be altered to suit different articles (A) or retail environments. Furthermore, whilst the exemplary embodiments, detailed above, described the use of two separate blanks to form the two parts of the package, it is contemplated within the scope of this invention that a unitary two-part blank may also be employed. Such a unitary two-part blank may incorporate some frangible line or other means of separating the first and second parts of the blank from one another when required.

It will be recognised that as used herein, directional references such as 'top', 'base', 'end', 'side', 'inner' and 'outer' do not limit the respective panels to such orientation, but merely serve to distinguish these panels from one another. Similarly, references to 'first' and 'second' parts are included to distinguish elements of the design and are not intended to limit the scope in any way. Any reference to hinged connection should not be construed as necessarily referring to a single fold line only: indeed it is envisaged that a hinged connection can be formed from one or more of the following: a score line, a frangible line or fold line, without departing from the scope of the invention.

The invention claimed is:

1. A carton for packaging articles, comprising a first part including a base panel for receiving articles and a second removable part including a structural element having a vertical size greater than the first part and sufficient to withstand a compressive force when the carton is stacked with like cartons, wherein the second part is disposed in stable contact with the first part, wherein the carton further comprises a retaining arrangement for preventing lateral separation of the first and second parts, the retaining arrangement comprising a deployable portion of one of the first and second parts and an abutting end of the other of the first and second parts, the one of the first and second parts having a first end where the deployable portion is located and a second end opposite to the first end, and wherein the abutting end of the other of the first and second parts is disposed to abut the deployable portion so that the deployable portion, when deployed, allows the abutting end to move laterally away from the second end of the one of the first and second parts to allow lateral separation of the second part from the first part in an endwise direction.

2. The carton according to claim 1, wherein the first part further includes a display panel for displaying information or graphics.

3. The carton according to claim 1, wherein the second part further includes a base panel connected to the structural element, wherein the structural element of the second part includes a pair of opposed side panels and a pair of opposed end panels so as to define an open top of the second part, wherein the first part is disposed within the second part such that the base panel of the first part is slidably disposed on the base panel of the second part and wherein the deployable portion is provided by one of the end panels of the second part.

4. A carton for packaging articles, comprising a first part including a base panel for receiving articles and a second removable part including a structural element having a vertical size greater than the first part and sufficient to withstand a compressive force when the carton is stacked with like cartons, wherein the second part is disposed in stable contact with the first part, wherein the carton further comprises a retaining arrangement for preventing lateral separation of the first and second parts, the retaining arrangement comprising a deployable portion of one of the first and second parts and an end of the other of the first and second parts, and wherein the end of the other of the first and second parts is disposed to abut the deployable portion so that the deployable portion, when deployed, allows lateral separation of the second part from the first part in an endwise direction to expose articles on the base panel of the first part, wherein the retaining arrangement further comprises one or more tabs projecting from one of the first and second parts to engage the other of the first and second parts so that vertical separation of the first and second parts is prevented.

5. The carton according to claim 4, wherein upper and lower portions of the carton comprise complementary tabs and apertures such that the tabs extending from the carton may engage apertures formed in another like carton when the carton and the other like carton are stacked one upon the other to restrict relative displacement.

6. The carton according to claim 4, wherein the one or more tabs project from the second part and received in one or more engaging apertures in the first part.

7. The carton according to claim 4, wherein the first part further includes a pair of opposed side panels and a pair of opposed end panels, the side and end panels extending upwardly from the base panel to define an open top of the first part, wherein the second part is disposed within the first part such that the structural element extends upwardly beyond respective upper edges of the side and end panels of the first part, and wherein the deployable portion is provided by one of the end panels of the first part.

8. The carton according to claim 7, wherein the structural element of the second part comprises a pair of opposed side support panels disposed alongside the side panels of the first part and an end support panel disposed alongside one of the end panels of the first part, the end support panel connecting between the side support panels.

9. A package for containing articles, which package comprises a group of articles, a supporting carton structure on which the group of articles is disposed and a removable carton structure including a pair of spaced side panels, the group having opposite sides, the supporting carton structure having a forward end and a backward end, the side panels of the removable carton structure being disposed alongside the opposite sides of the group of articles respectively, a height of the supporting carton structure at at least the forward end of the supporting carton structure being less than the height of the group of articles, the height of the side panels of the removable carton structure being greater than the height of the supporting carton structure, wherein the removable carton structure is in slidable contact with the supporting carton structure so as to be forwardly movable with respect to the supporting carton structure to be removed from the supporting carton structure, the package further comprising a retaining arrangement for preventing undesired forward movement of the removable carton structure.

10. The package according to claim 9, wherein the retaining arrangement comprises a deployable portion of one of the supporting and removable carton structures and an end of the other of the supporting and removable carton structures, the end of the other of the supporting and removable carton structures being disposed to abut the deployable portion so that the deployable portion, when deployed, allows forward movement of the removable carton structure to expose the group of articles on the supporting carton structure.

11. The package according to claim 10, wherein the retaining arrangement further comprises one or more tabs projecting from one of the supporting and removable carton structures to engage the other of the supporting and removable carton structures so that relative vertical movement of the supporting and removable carton structures is prevented.

12. The package according to claim 9, wherein the supporting carton structure comprises a display panel for displaying information or graphics.

13. The package according to claim 9, wherein at least the removable carton structure comprises apertures for facilitating air flow around the articles of the group.

14. The package according to claim 9, wherein the supporting carton structure comprises a base panel, a pair of side panels and a pair of end panels, the supporting carton structure having an open top, and the removable carton structure is disposed within the supporting carton structure.

15. The package according to claim 9 wherein the supporting carton structure comprises a base panel on which the group of article is disposed, the removable carton structure further comprises a base panel, and the supporting carton structure is disposed within the removable carton structure such that the base panel of the removable carton structure is slidably disposed under the base panel of the supporting carton structure.

* * * * *